US008257288B2

(12) United States Patent
Hansen et al.

(10) Patent No.: US 8,257,288 B2
(45) Date of Patent: Sep. 4, 2012

(54) CHEST COMPRESSION APPARATUS HAVING PHYSIOLOGICAL SENSOR ACCESSORY

(75) Inventors: Leland G. Hansen, St. Paul, MN (US); Greg White, St. Paul, MN (US)

(73) Assignee: RespirTech, St. Paul, MN (US)

( * ) Notice: Subject to any disclaimer, the term of this patent is extended or adjusted under 35 U.S.C. 154(b) by 719 days.

(21) Appl. No.: 12/482,219

(22) Filed: Jun. 10, 2009

(65) Prior Publication Data

US 2009/0306556 A1 Dec. 10, 2009

Related U.S. Application Data

(60) Provisional application No. 61/060,379, filed on Jun. 10, 2008.

(51) Int. Cl.

| | |
|---|---|
| ***A61H 7/00*** | (2006.01) |
| ***A61H 19/00*** | (2006.01) |
| ***A61H 31/00*** | (2006.01) |
| ***A61H 31/02*** | (2006.01) |

(52) U.S. Cl. ..... 601/152; 601/151; 601/44

(58) Field of Classification Search ..... 601/41–44, 601/148–152; 602/12; 606/202; 128/205.24, 128/204.18, 204.21, 204.23

See application file for complete search history.

(56) References Cited

U.S. PATENT DOCUMENTS

| | | | |
|---|---|---|---|
| 2,588,192 | A | 3/1952 | Akerman et al. |
| 3,462,778 | A | 8/1969 | Whitney |
| 4,135,500 | A | 1/1979 | Gorran |
| 4,197,837 | A | 4/1980 | Tringali et al. |
| 4,311,135 | A | 1/1982 | Brueckner et al. |
| 4,519,146 | A | 5/1985 | Herrington |
| 4,653,498 | A | 3/1987 | New, Jr. et al. |
| 4,838,263 | A | 6/1989 | Warwick et al. |
| 4,977,889 | A | 12/1990 | Budd |
| 5,056,505 | A | 10/1991 | Warwick et al. |
| 5,453,081 | A | 9/1995 | Hansen |
| 5,490,820 | A | 2/1996 | Schock et al. |
| 5,569,170 | A | 10/1996 | Hansen |
| 5,769,797 | A | 6/1998 | Van Brunt et al. |
| 5,769,800 | A | 6/1998 | Gelfand et al. |
| 5,997,488 | A | 12/1999 | Gelfand et al. |
| 6,030,353 | A | 2/2000 | Van Brunt |
| 6,036,662 | A | 3/2000 | Van Brunt et al. |
| 6,155,996 | A | 12/2000 | Van Brunt et al. |

(Continued)

FOREIGN PATENT DOCUMENTS

| | | |
|---|---|---|
| WO | WO-95/32753 | 12/1995 |

OTHER PUBLICATIONS

International Preliminary Report on Patentability, PCT/US2006/034783, Mar. 27, 2008.

(Continued)

*Primary Examiner* — Kristen Matter
(74) *Attorney, Agent, or Firm* — Briggs and Morgan, P.A.

(57) ABSTRACT

A chest compression system and method of use for respiratory therapies such as cystic fibrosis, including an air flow generator, a pulse frequency control component having a fan blade for producing a series of air pulses communicated to a patient-worn garment during a therapy session. The system further includes one or more patient physiologic sensors capable of capturing patient information during the therapy session. The sensors may include a blood oximeter or a mouthpiece used to evaluate pulmonary function. An airway congestion monitoring system provides airway and lung congestion trend analysis. Adjustments are made to the series of air pulses based on a patient's therapy session data.

25 Claims, 16 Drawing Sheets

U.S. PATENT DOCUMENTS

| | | | |
|---|---|---|---|
| 6,179,796 | B1 | 1/2001 | Waldridge |
| 6,182,658 | B1 | 2/2001 | Hayek |
| 6,210,345 | B1 | 4/2001 | Van Brunt |
| 6,254,556 | B1 | 7/2001 | Hansen et al. |
| 6,340,025 | B1 | 1/2002 | Van Brunt |
| D453,560 | S | 2/2002 | Van Brunt |
| 6,379,316 | B1 | 4/2002 | Van Brunt et al. |
| D456,591 | S | 5/2002 | Hansen |
| 6,415,791 | B1 | 7/2002 | Van Brunt |
| D461,897 | S | 8/2002 | Hansen et al. |
| 6,471,663 | B1 | 10/2002 | Van Brunt et al. |
| 6,488,641 | B2 | 12/2002 | Hansen |
| D469,876 | S | 2/2003 | Hansen et al. |
| 6,547,749 | B2 | 4/2003 | Hansen |
| D478,989 | S | 8/2003 | Hansen et al. |
| 6,605,050 | B2 | 8/2003 | Hansen |
| 6,676,614 | B1 | 1/2004 | Hansen et al. |
| 6,733,464 | B2 | 5/2004 | Olbrich et al. |
| 6,736,785 | B1 | 5/2004 | Van Brunt |
| 6,757,916 | B2 | 7/2004 | Mah et al. |
| 6,764,455 | B2 | 7/2004 | Van Brunt et al. |
| 6,910,479 | B1 | 6/2005 | Van Brunt |
| 6,916,298 | B2 | 7/2005 | Van Brunt et al. |
| 6,958,046 | B2 | 10/2005 | Warwick et al. |
| 2002/0014235 | A1 | 2/2002 | Rogers et al. |
| 2002/0111571 | A1 | 8/2002 | Warwick et al. |
| 2006/0009718 | A1 | 1/2006 | Van Brunt et al. |

OTHER PUBLICATIONS

International Search Report and Written Opinion, PCT/US2006/034783, Apr. 18, 2007.

Milla, Carlos E. et al., "High-Frequency Chest Compression: Effect of the Third Generation Compression Waveform", *Instrument Research*, Jul./Aug. 2004, 322-328.

PCT Written Opinion and Search Report, mailed Jan. 27, 2010.

CHEST COMPRESSION APPARATUS HAVING PHYSIOLOGICAL SENSOR ACCESSORY

RELATED APPLICATIONS

This applications claims the benefit of U.S. Provisional Patent Application Ser. No. 61/060,379, filed Jun. 10, 2008, which is incorporated by reference herein.

TECHNICAL FIELD

The present invention relates to oscillatory chest compression devices and systems and more particularly to an air pulse delivery system having multiple operating modes utilizing one or more physiological sensor accessories adapted for coupling to a patient during a therapy session.

BACKGROUND OF THE INVENTION

A variety of high frequency chest compression ("HFCC") systems have been developed to aid in the clearance of mucus from the lung. Such systems typically involve the use of an air delivery device, in combination with a patient-worn vest. Such vests were developed for patients with cystic fibrosis, and are designed to provide airway clearance therapy. The inflatable vest is linked to an air pulse generator that provides air pulses to the vest during inspiration and/or expiration. The air pulses produce transient cephalad air flow bias spikes in the airways, which moves mucous toward the larger airways where it can be cleared by coughing. The prior vest systems differ from each other, in at least one respect, by the valves they employ (if any), and in turn, by such features as their overall weight and the wave form of the air produced.

BRIEF SUMMARY OF THE INVENTION

The present invention is generally directed to a chest compression apparatus for applying a force to the thoracic region of the patient. More particularly, the present invention is directed to an apparatus for applying chest compressions during a therapy session in combination with a physiologic sensor accessory, such as a pulse oximeter or lung function monitor.

The force applying mechanism includes a vest or other wearable air chamber for receiving pressurized air. The apparatus further includes a mechanism for supplying pressure pulses of pressurized air to the vest. For example, the pulses may have a sinusoidal, triangular, square wave form, etc. Additionally, the apparatus includes a mechanism for venting the pressurized air from the bladder. In addition to performance that is comparable to, if not better than, that provided by prior devices, the apparatus of the present invention can be manufactured and sold for considerably less than current devices, and can be provided in a form that is far more modular and portable than existing devices.

In a preferred embodiment of the present invention, a fan valve is used to establish and determine the rate and duration of air pulses entering the vest from the pressure side and allow air to evacuate the bladder on the depressurizing side. An air generator (e.g., blower) is used on the pressurizing side of the fan valve. The fan valve advantageously provides a controlled communication between the blower and the bladder.

One exemplary embodiment of the present invention includes a plurality of physiological sensor accessories adapted for use by the patient before, during or after a therapy session utilizing the pulsating air vest. Sensor accessories may include a pulse oximeter, $CO_2$ meter, NO meter and lung function evaluator.

In oximeters, input signals are received from a sensor device which is directly connected to the blood-carrying tissue of a patient, such as a finger or ear lobe. The sensor device generally consists of a red LED, an infrared LED, and one or two photodetectors. Light from each LED is transmitted through the tissue, and the photodetectors detect the amount of light which passes through the tissue. The detected light consists of two components for each bandwidth. An AC component represents the amount of pulsating blood detected, while the DC component represents the amount of non-pulsating blood. Therefore, four separate components of detected light are examined in order to determine the arterial oxygen saturation: red DC, red AC, infrared DC and infrared AC. The amount of light detected is then used to determine the oxygen saturation in the blood of the patient based on known equations. In a traditional oximeter, the sensor output signal is converted to an analog voltage and then separated into infrared and red components.

The present apparatus provides a variety of solutions and options to the treatment problem faced by people having cystic fibrosis. The advantages of the invention relate to benefits derived from a treatment program using the present apparatus rather than a conventional device having a rotary valve and corresponding pulses. In this regard, a treatment program with the present apparatus provides a cystic fibrosis patient with independence in that the person can manipulate, move, and operate the machine alone. He/she is no longer required to schedule treatment with a trained individual. This results in increased psychological and physical freedom and self esteem. The person becomes flexible in his/her treatment and can add extra treatments, if desired, for instance in order to fight a common cold. An additional benefit is the corresponding decrease in cost of treatment, as well as a significant lessening of the weight (and in turn, increased portability) of the device itself.

A system in accordance with the present invention may include a housing having a port, a therapy system carried by the housing and operable to deliver HFCC therapy to a patient in accordance with a set of operating parameters, and a memory device coupled to the port and configured to store at least a portion of the set of operating parameters. The therapy system may be operable in accordance with the portion of the set of operating parameters stored in the memory device. The memory device may comprise a read/write memory. Alternatively or additionally, the memory device may comprise a read-only memory.

The memory device may store one or more of a plurality of pre-programmed therapy modes to allow a caregiver to deliver HFCC therapy to a patient in accordance with any one of the plurality of pre-programmed therapy modes stored in the memory device. The plurality of pre-programmed therapy modes may comprise a step program mode, a sweep program mode, a training program mode, and the like. Alternatively or additionally, the memory device may store one or more of a plurality of customized therapy modes to allow a caregiver to deliver a customized HFCC therapy to a patient in accordance with any one of the plurality of customized therapy modes stored in the memory device. The memory device may store information regarding functionalities available to a patient. The functionalities available to a patient may comprise a positive expiratory pressure (PEP) therapy, a nebulizer therapy, an intermittent positive pressure breathing (IPPB) therapy, a cough assist therapy, a suction therapy, a bronchial dilator therapy, and the like.

A user interface apparatus of the therapy system may include a touch screen display. The display may be signaled by software of the therapy system to display a data download screen. The data download screen may comprise a patient list and a list of device selection buttons. The patient list may comprise patient ID numbers. Each device selection button may be associated with one of the plurality of devices. The plurality of devices may comprise one or more of physiological sensors, a printer, a PC, a laptop, a PDA button, and the like. One or more of the plurality of devices may be associated with a computer network of a hospital. The data relating to HFCC therapy delivered to a patient may comprise one or more of the following: a type of the HFCC therapy, the settings of the various operating parameters associated with the HFCC therapy, data associated with any tests or assessments of the patient, including graphs and tables of such data, date and time of the therapy, and patient personal information. The data associated with a patient's assessment may comprise oximetry and air flow data.

The system may further comprise a wireless receiver carried by the housing and operable to wirelessly receive updates relating to software of the therapy system. The system may be operable to wirelessly receive updates relating to problem diagnoses. The wireless transmitter and/or the wireless receiver may be included as part of a wireless transceiver. Alternatively, the housing may include a data port to receive updates relating to software of the therapy system and/or updates relating to problem diagnoses. The wireless transmission of the data may be in accordance with known protocols.

The system may include an accessory mouthpiece coupled to a pressure monitoring system via a pair of air lines. The mouthpiece, via an internal flow restricting structure, establishes a pressure differential which is communicated to the monitoring device. During patient expiration, the mouthpiece functions to accurately and consistently provide a pressure differential to the monitor for conversion into a patient-usable format. One aspect of the monitoring system is the provision of statistical analyses of stored measurements, for example to provide a trend analysis and report of the information for the patient.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
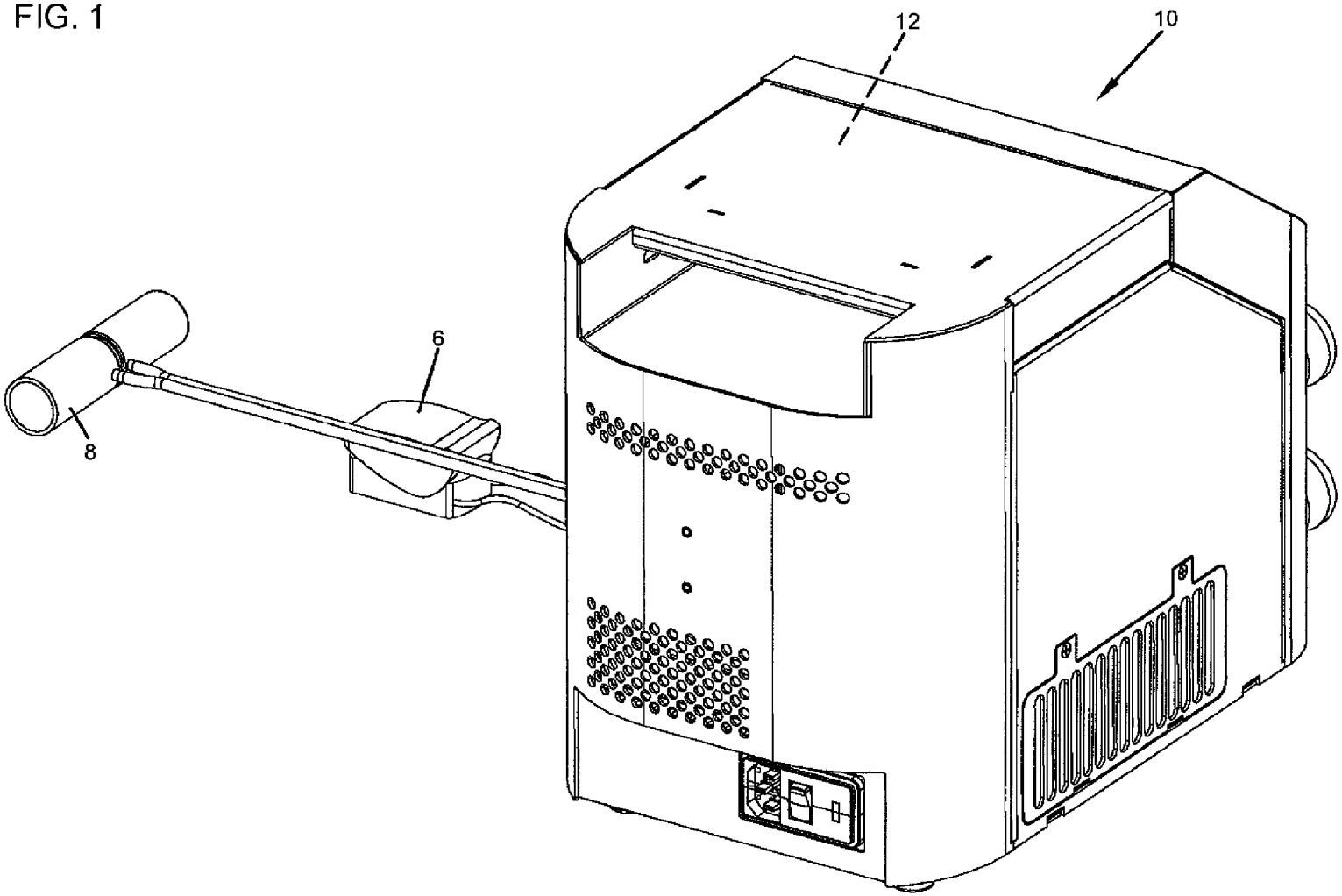
FIGS. 1-2 are perspective illustrations of an air system embodiment in accordance with the present invention.
Figure 2:
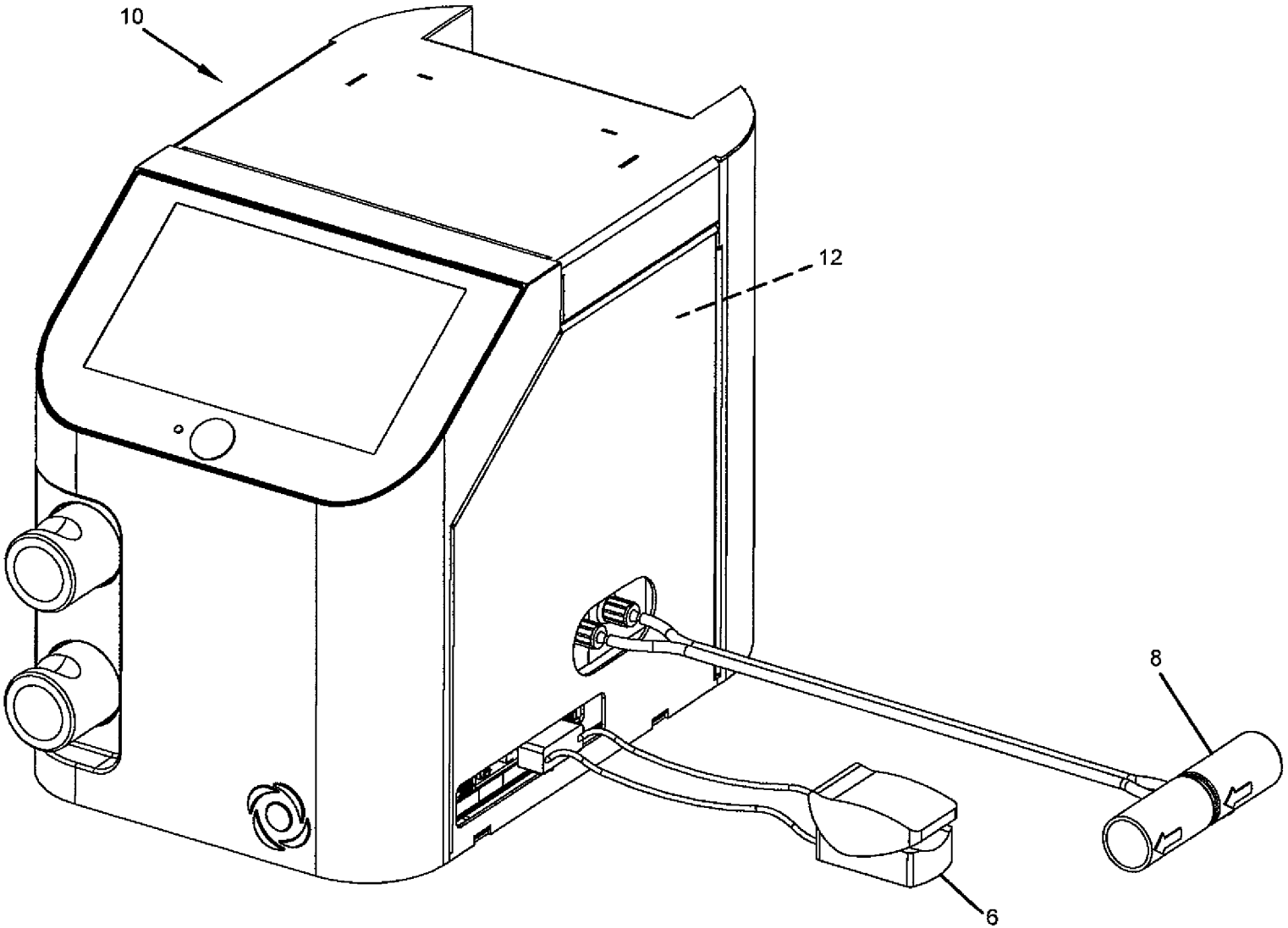

An embodiment of a chest compression system according to the present invention is referenced herein by the numeral 10. FIGS. 1-2 illustrate perspective views of an exemplary embodiment of system 10. As described in greater detail herein, system 10 includes an air flow generator 12 providing intermittent pulses to a patient vest (not shown) during a therapy session. System 10 additionally includes a pair of physiological data acquisition devices 6, 8 adapted to be operatively coupled to a patient before, during or after a therapy session. In this example, sensor device 6 is a pulse oximeter sensor and sensor device 8 is a mouthpiece through which the patient exhales in accordance with a lung function evaluation system as described herein.

Figure 3:
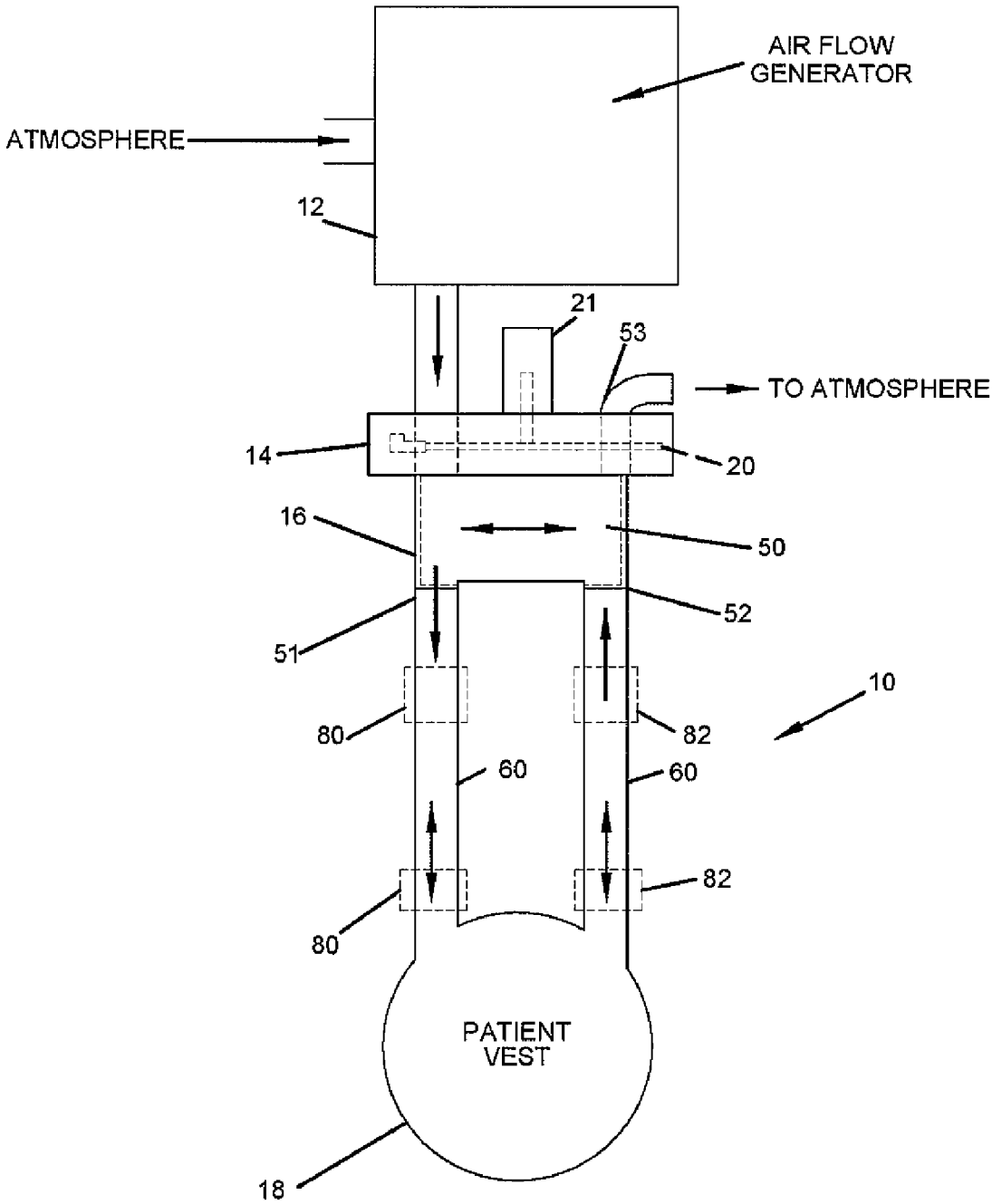
FIG. 3 is a depiction of functional aspects of an air system according to the present invention, with arrows depicting air flow therethrough.

FIG. 3 is a somewhat diagrammatical air flow diagram associated with system 10. System 10 includes an air flow generator component 12, flowably connected to a pulse frequency control module 14, which in turn is flowably connected to a pressure control device 16, and finally to a vest 18 worn by the patient. The patient may be a human or other animal. For example, both human and equine applications may be practicable, with differently sized vests 18 being defined by the particular applications. In use, the air flow generator (e.g., motor driven blower) delivers pressurized air to vest 18, via pulse frequency control unit 14 that preferably includes one or more rotating (e.g., fan-like) blades. Air flow generator 12 includes an electric blower, the speed of which may be fixed or variable depending on an application.

System 10 includes a blood oximeter for monitoring the blood oxygen saturation of the patient before, during or after a therapy session. In a preferred embodiment the sensor accessory 6 is attached to a blood-carrying tissue sample of the patient, such as the finger or ear lobe. In one example, sensor 6 consist of a red LED, an infrared LED, and a single photodetector, but the sensor can include three or more LED's of different wavelengths and an associated plurality of photodetectors. The LED's are driven by signals from a microprocessor, which may be the system 10 controller. Light from the LED's is transmitted through the tissue sample, and is detected by the photodetector, which produces an analog current signal with an amplitude proportional to the amount of light detected in each bandwidth. The current signal from the photodetector is then digitized by the microprocessor. Ambient interference identification and elimination, and signal filtering can be performed by means of digital signal processing software routines in the microprocessor. Once the signals are processed, the microprocessor calculates a ratio of a DC component representing the non-pulsating blood flow, and a AC component indicating the pulsatile blood flow. The microprocessor then determines the arterial oxygen saturation by comparing the result to the value stored in a look-up table or otherwise determined. A variety of blood oxygen sensors and controllers are suitably adaptable for use within system 10.

Figure 5:
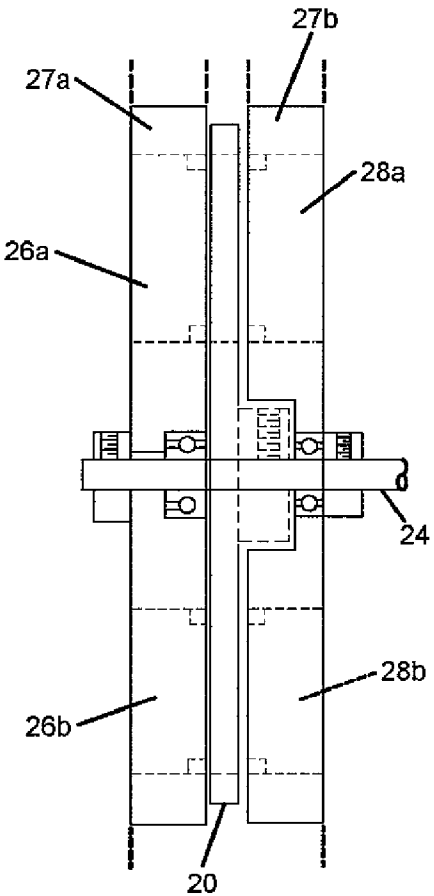
FIG. 5 is another side elevational view of a blade valve of FIG. 4.
Figure 4:
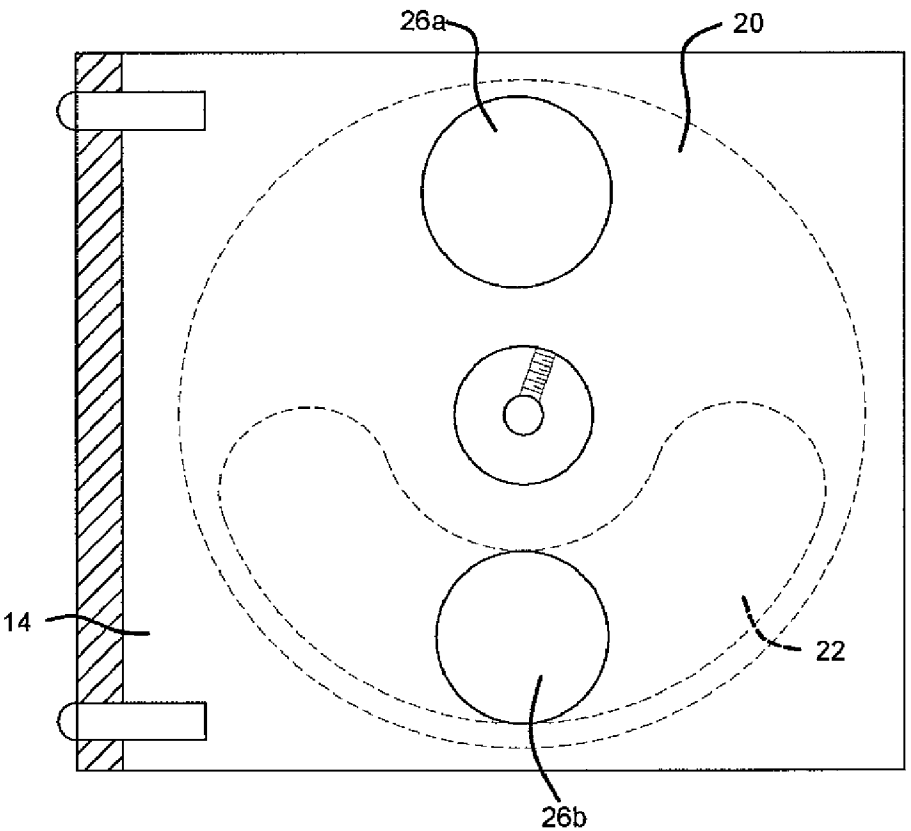
FIG. 4 is a side elevational view of a portion of a blade valve suitable for use with an embodiment of the present invention.

FIGS. 4-5 illustrate pulse frequency control unit 14. Unit 14 includes a generally circular valve blade 20, rotatable upon a central axis of motor 21 and having one or more cutout portions 22. Blade 20 is retained on a centrally located motor driven shaft 24, which serves to rotate blade 20, and in turn, provide airflow access to and through air ports 26*a* and 26*b*, respectively. Motor 21 is coupled to motor shaft 24 and provides rotational control of blade 20. Motor 21 is a stepper motor providing accurate control of blade 20 position in order to define particular waveforms applied to vest 18. As shown in corresponding FIG. 5, a pair of plates 27*a* and 27*b* are mounted on an axis concentric with that of motor drive shaft 24, and effectively sandwich the blade assembly between them. The end plates are provided with corresponding air ports 26*a* and 26*b* (in plate 27*a*) and 28*a* and 28*b* (in plate 27*b*). The air ports are overlapping such that air delivered from the external surface of either end plate will be free to exit the corresponding air port in the opposite plate, at such times as the blade cutout portion of the valve blade is itself in an overlapping position therebetween. By virtue of the rotation of cutout portions past the overlapping air ports, in the course of constant air delivery from one air port toward the other, the rotating fan blade effectively functions as a valve to permit air to pass into the corresponding air port in a semi-continuous and controllable fashion. The resultant delivery may take a sinusoidal wave form, by virtue of the shape and arrangement of the fan blade cutout portions.

Pulse frequency module 14, in a preferred embodiment, is provided in the form of a motor-driven rotating blade 20 ("fan valve") adapted to periodically interrupt the air stream from the air flow generator 12. During these brief interruptions air pressure builds up behind the blade. When released, as by the passage of blade 20, the air travels as a pressure pulse to vest 18 worn by the patient. The resulting pulses can be in the form of fast rise, sine wave pressure pulses. Alternative waveforms can be defined through accurate control of blade 20, such as via an electronically controlled stepper motor. These pulses, in turn, can produce significantly faster air movement in the lungs, in the therapeutic frequency range of about 5 Hz to about 25 Hz, as measured at the mouth. In combination with higher flow rates into the lungs, as achieved using the present apparatus, these factors result in stronger mucus shear action, and thus more effective therapy in a shorter period of time.

Fan valve 20 of the present invention can be adapted (e.g., by configuring the dimensions, pitch, etc. of one or more fan blades) to provide wave pulses in a variety of forms, including sine waves, near sine waves (e.g., waves having precipitous rising and/or falling portions), and complex waves. As used herein a sine wave can be generally defined as any uniform wave that is generated by a single frequency, and in particular, a wave whose amplitude is the sine of a linear function of time when plotted on a graph that plots amplitude against time. The pulses can also include one or more relatively minor perturbations or fluctuations within and/or between individual waves, such that the overall wave form is substantially as described above. Such perturbations can be desirable, for instance, in order to provide more efficacious mucus production in a manner similar to traditional hand delivered chest massages. Moreover, pulse frequency module 14 of the present invention can be programmed and controlled electronically to allow for the automatic timed cycling of frequencies, with the option of manual override at any frequency.

Figure 7:
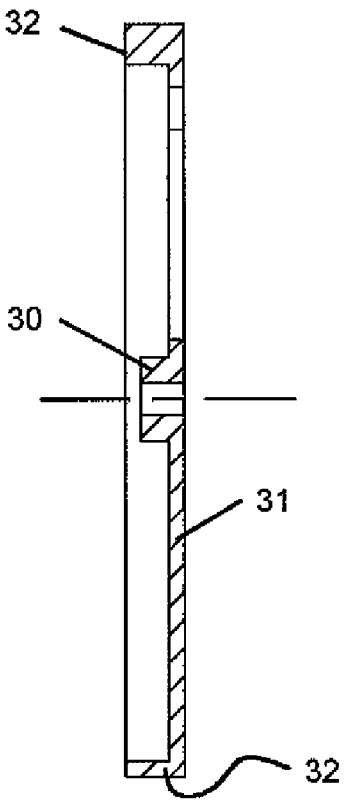
FIG. 7 is a cross sectional view of the blade of FIG. 6, taken along lines 4-4.
Figure 6:
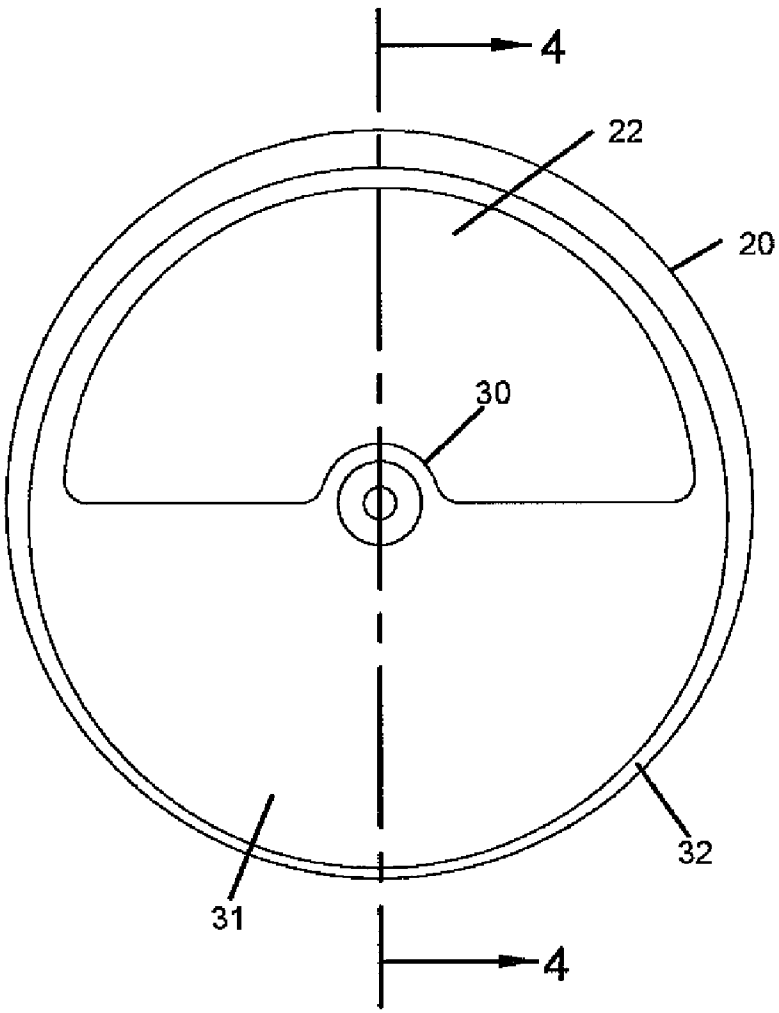
FIG. 6 is a top plan view of a rotationally balanced blade suitable for use within a rotary blade valve including within an embodiment of the present invention.

Referring to FIGS. 6-7, blade 20 includes hub 30, a base plate element 31 and a variable thickness outer wall 32. Outer wall 32 is thinner in the region generally opposite cutout portion 22 and thicker proximate to the cutout portion 22. Preferably the outer wall 32 thickness is varied in order to statically and dynamically balance the blade 20. By balancing blade 20, a reduction in vibration and noise can be provided.

Figure 8:
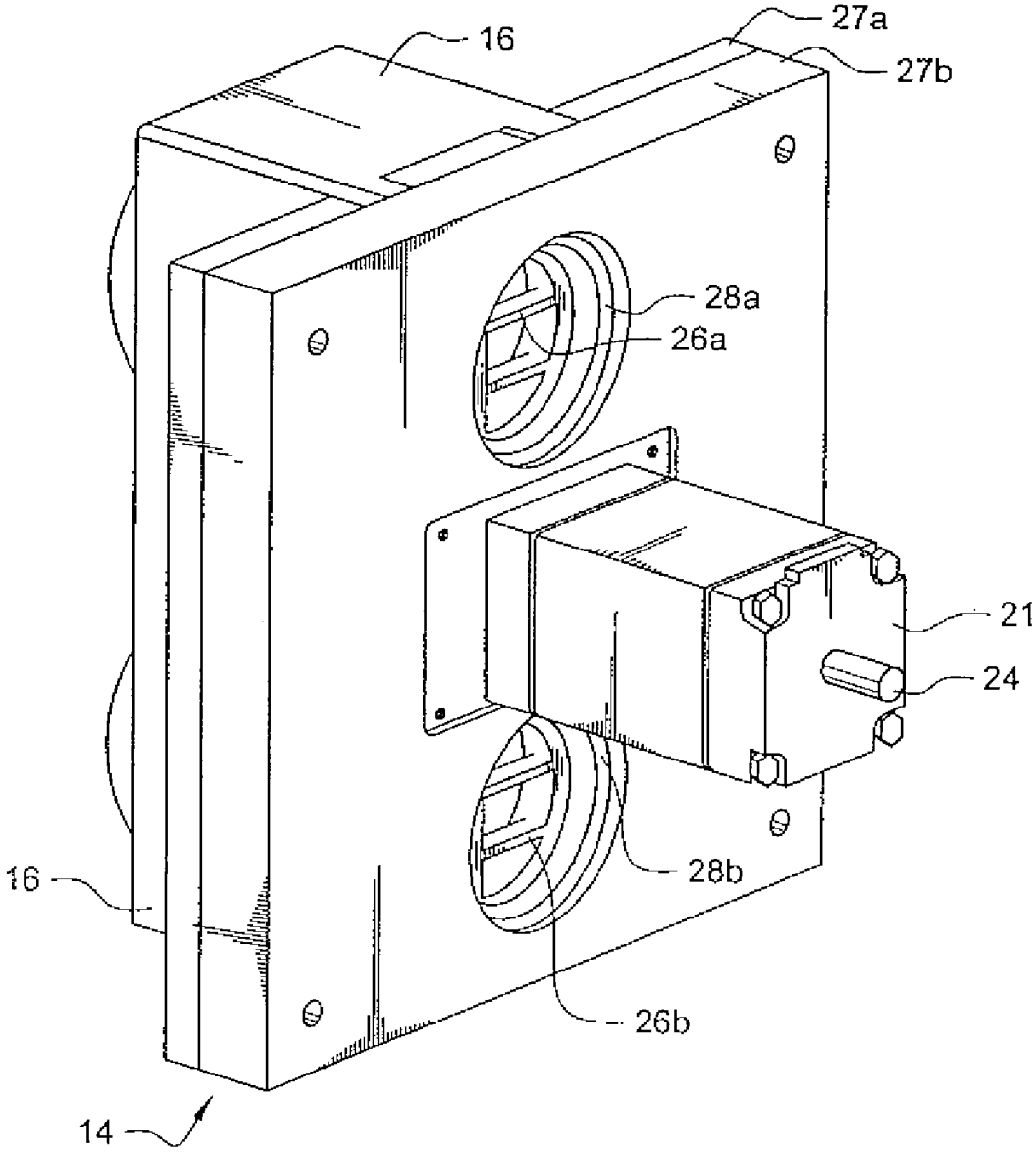
FIGS. 8-13 are perspective views of internal and external components of the apparatus of FIG. 1.
Figure 9:
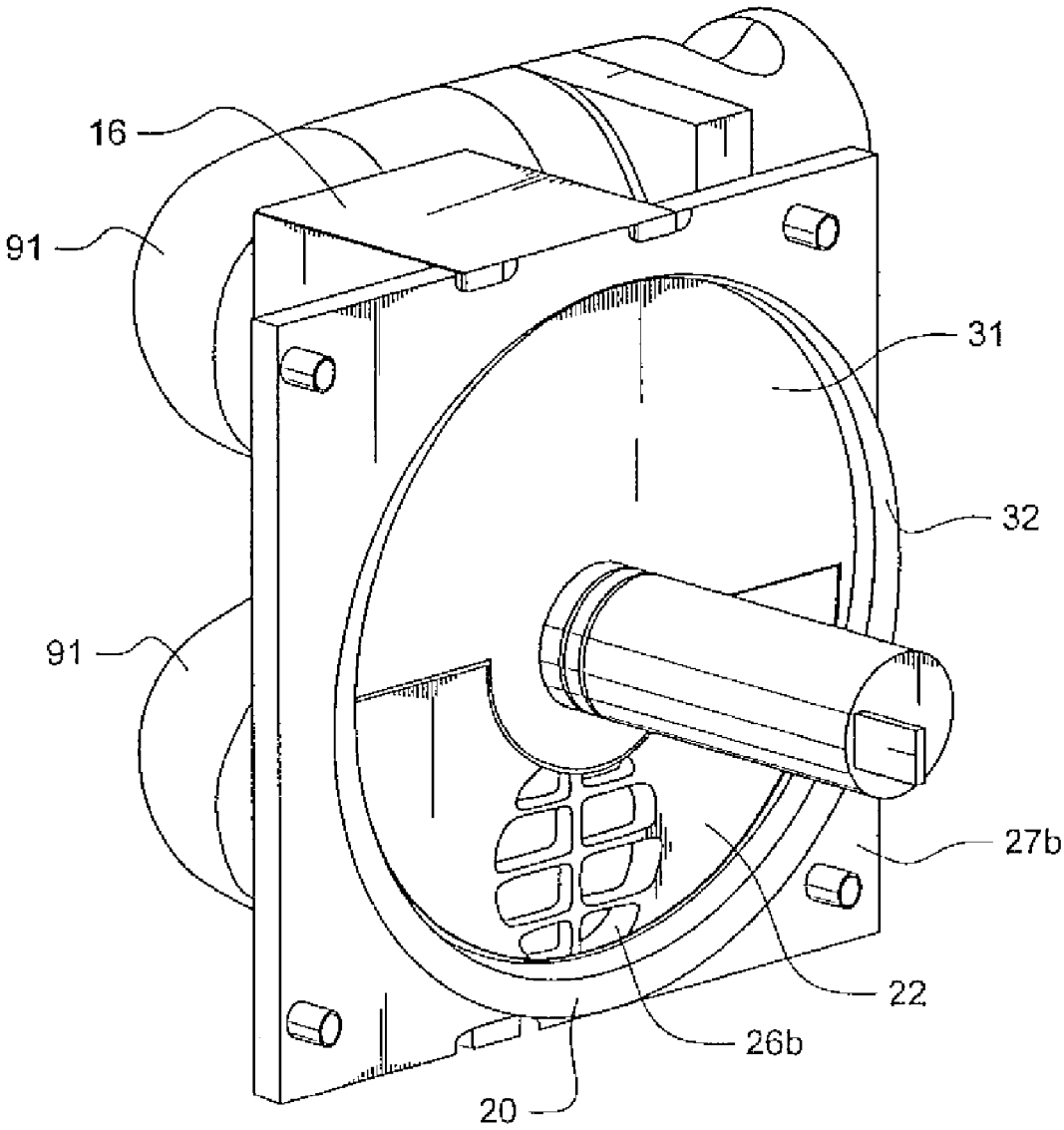
Figure 10:
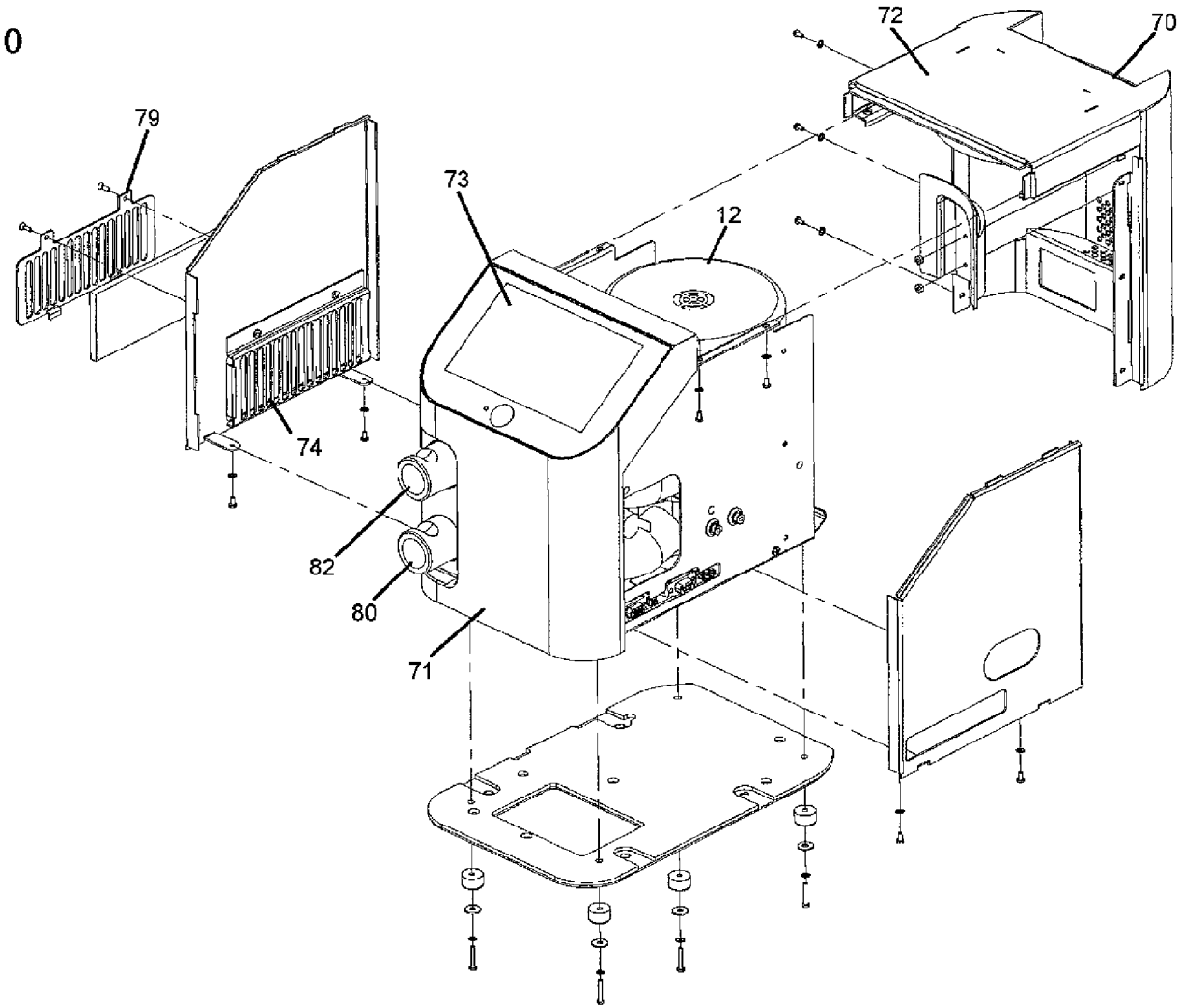
Figure 11:
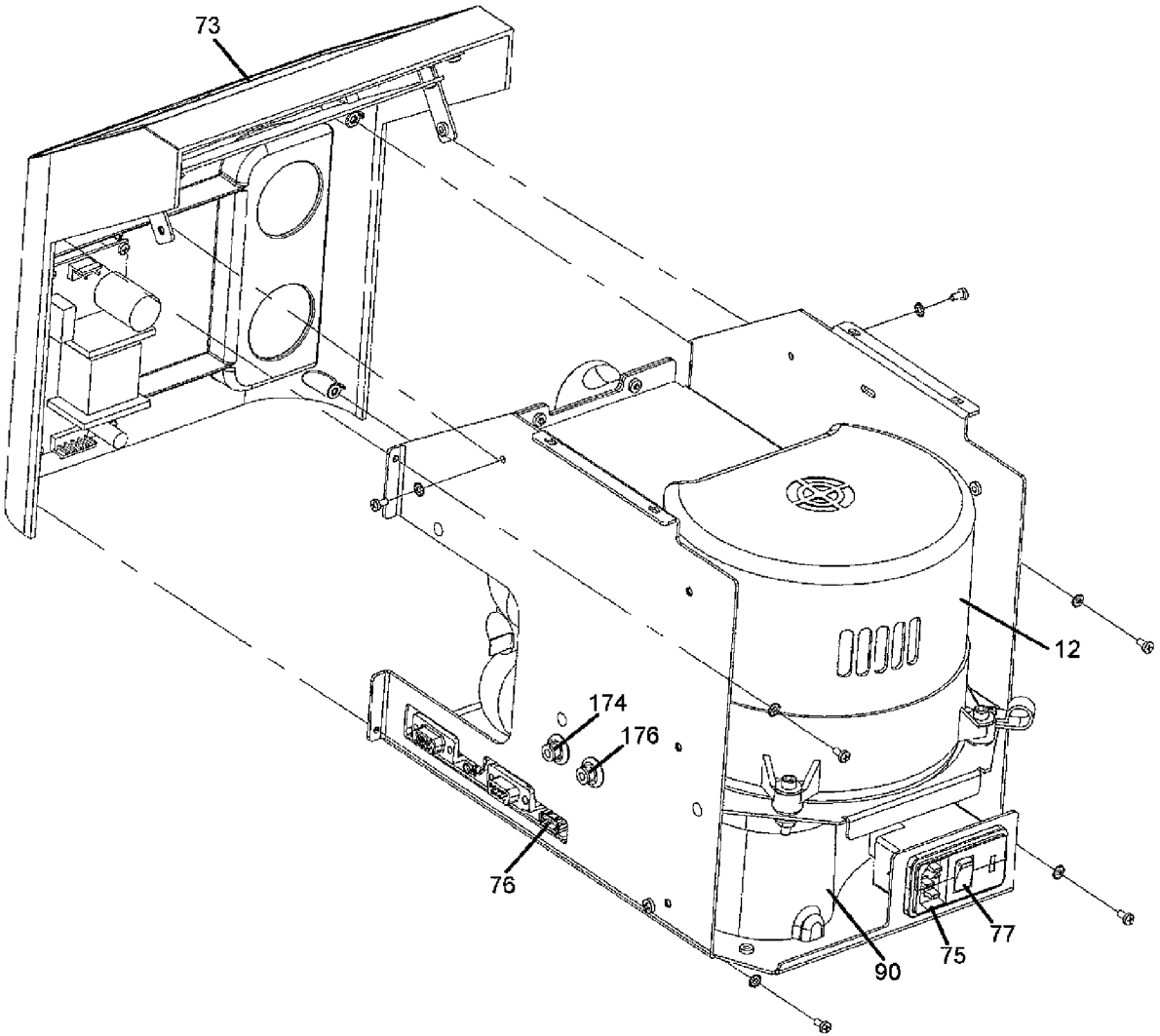

Referring to FIGS. 8-9, pressure control unit 16 defines a balancing chamber/manifold 50 in air communication with ports 26*a* and 26*b* of module 14. Chamber 50 is adapted to receive or pass air through ports 26*a* and 26*b* of pulse frequency control module 14, and effectively provides a manifold or air chamber to deliver air to vest 18 or atmosphere by means of vest exit ports 51, 52 and atmosphere exit port 53. As depicted in FIG. 3, air manifold 50 of pressure control unit 16 defines a fluid communicating bypass between ports 51 and 52, and hence fluid communication between the ports of pulse frequency control module 14 and air lines 60 to patient vest 18. During operation, air chamber 50 receives HFCC pulse pressure waves through ports 26*a*, 28*a*. Port 53 is connected to port 28*b* of frequency control module 14 and is closed to atmosphere when 26*a* is open and open when 26*a* is closed. Ports 51 and 52 are connected to the inflatable vest 18 via flexible tubing 60.

Pulse pressure control 16 is located between frequency control module 14 and vest 18 worn by the patient. In the illustrated embodiment, air chamber 50 of pulse pressure control 16 is immediately adjacent pulse frequency control module 14. In one preferred embodiment, a structure defining the air chamber is directly connected to the outlet ports of the pulse frequency control module 14. The manifold or air chamber 50 provides fluid communication between air lines 60 extending to vest 18 and the bladder-side ports of the pulse frequency control module 14. Pressure control unit 16 may be active or passive. For example, an active pressure control unit may include, for example, valves and electric solenoids in communication with an electronic controller, microprocessor, etc. A passive pressure control unit 16 may include a manual pressure relief or, in a simple embodiment, pressure control unit 16 may include only the air chamber providing air communication between the air lines extending to the vest 18 and not otherwise including a pressure relief or variable pressure control.

FIGS. 10-13 illustrate external and internal aspects of system 10. System 10 includes shell or housing 70 having front portion 71 and top portion 72. Front portion 71 includes a user interface including display 73. System 10 defines air openings 74, electrical connection 75, telecom connections 76, and power switch 77. User interface includes a visual display 73 which allows the patient to control device 10. Air openings 74 permit air entry into system 10. A removable filter 79 is adapted to be periodically removed and cleaned to minimize debris entry into system 10.

System 10 further includes a plurality of quick connect air couplings 80, 82 which couple vest 18 with system 10 via air hoses 60. Each quick connect air coupling 80, 82 includes male and female portions and a latch or other release for quickly disconnecting the portions. The benefits of the quick connect air couplings include minimization of inadvertent air hose disconnects and improved freedom of movement as the locking air coupling permit rotation between the air hose and the vest or air generator.

Figure 12A:
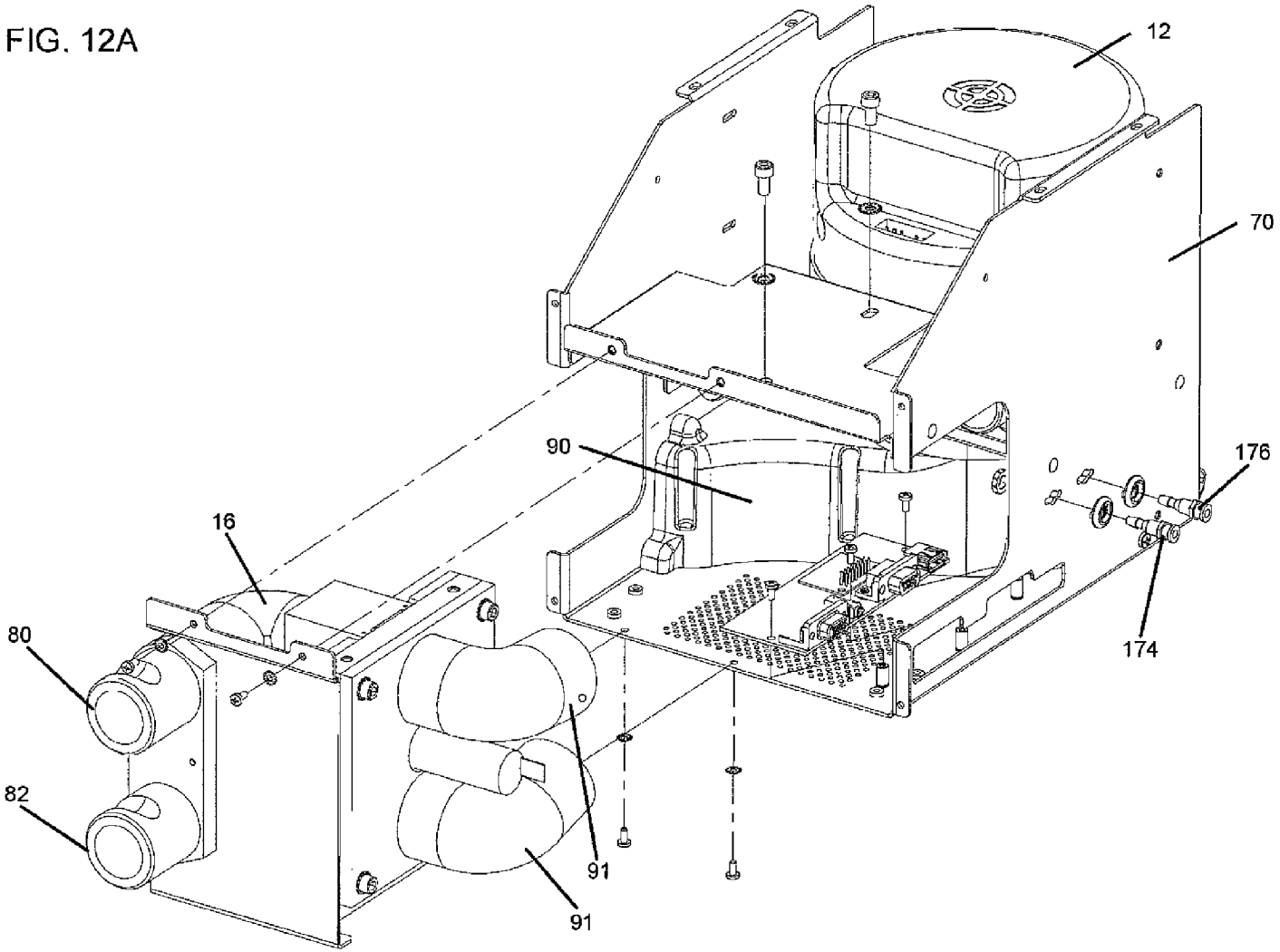
Figure 12B:
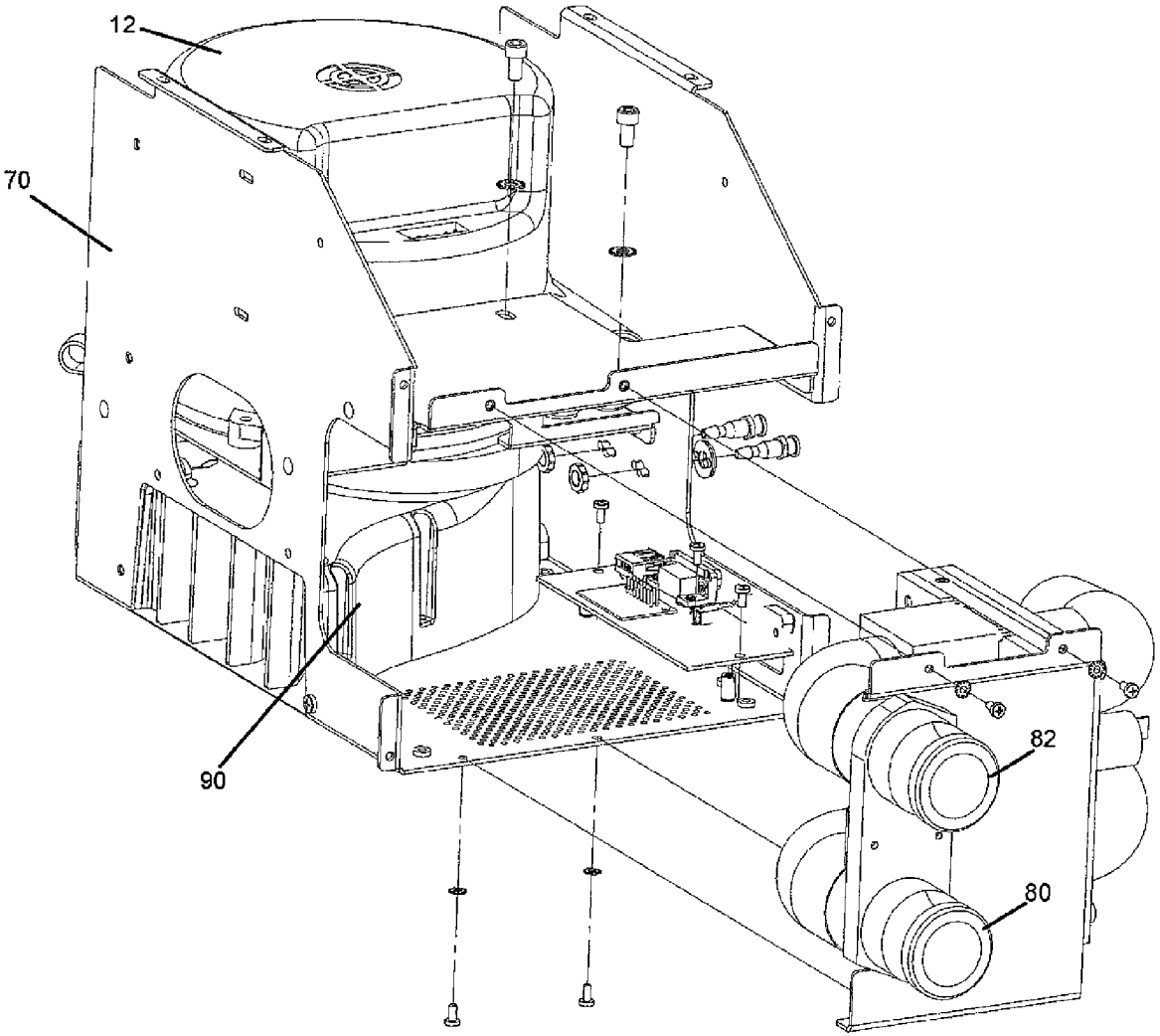
Figure 13A:
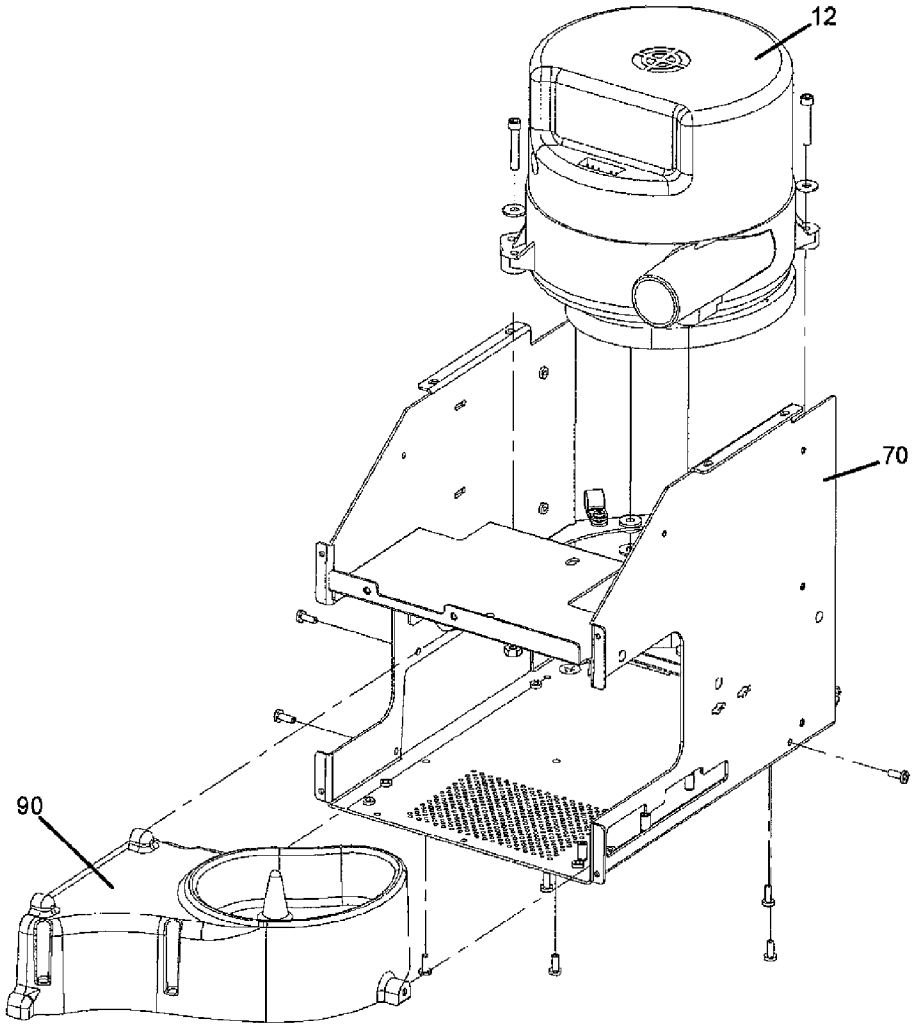
Figure 13B:
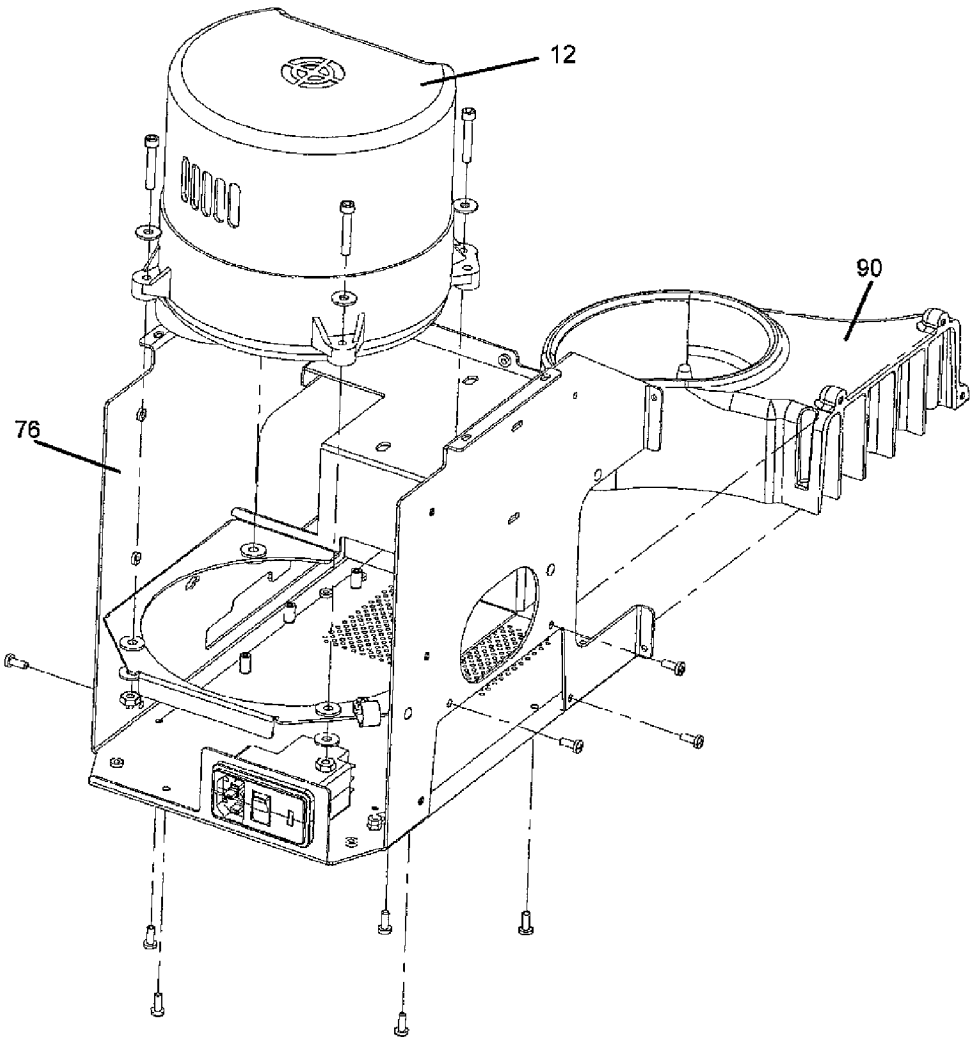

As shown in FIGS. 12-13, plenum 90 is defined between an inlet port of air flow generator 12 and external housing 70. Plenum 90 defines an air conduit between for air entering system 10. Plenum 90 includes a pair of openings, one positioned near opening 74 and the other positioned at an inlet to the electric blower motor of air flow generator 12. Plenum 90 is provided with a generally decreasing cross sectional volume as it extends from air opening 74 towards the inlet of air flow generator 12. Plenum 90 promotes a reduction in sound generation as air is more efficiently drawn into generator 12 as compared to an open fan inlet. Tubular couplings 91 provide fluid communication to air flow generator 12 to control devices 14, 16 and quick connect air couplings 80, 82.

Figure 14:
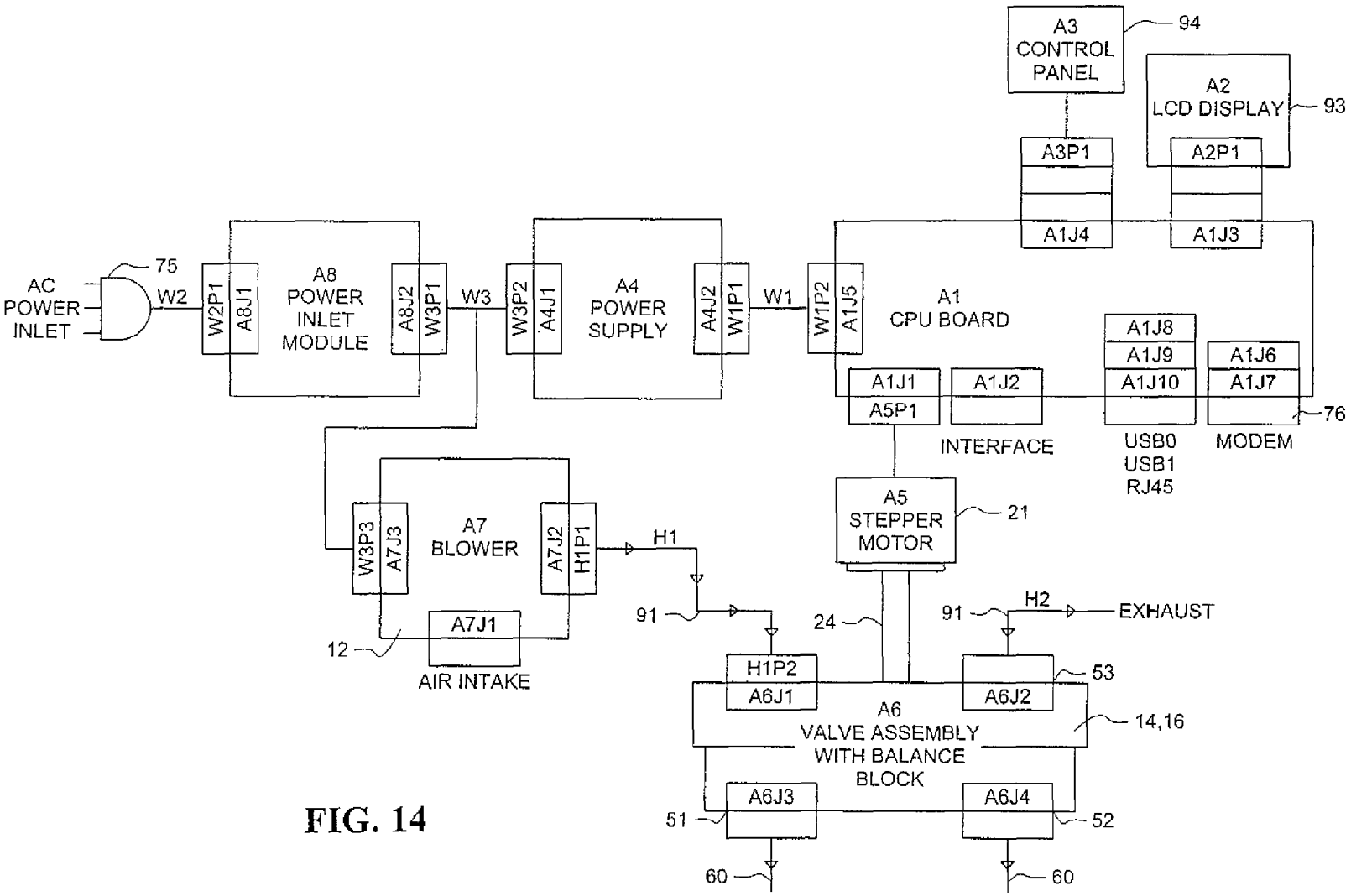
FIG. 14 is a functional schematic of the system of FIG. 1.
Figure 15:
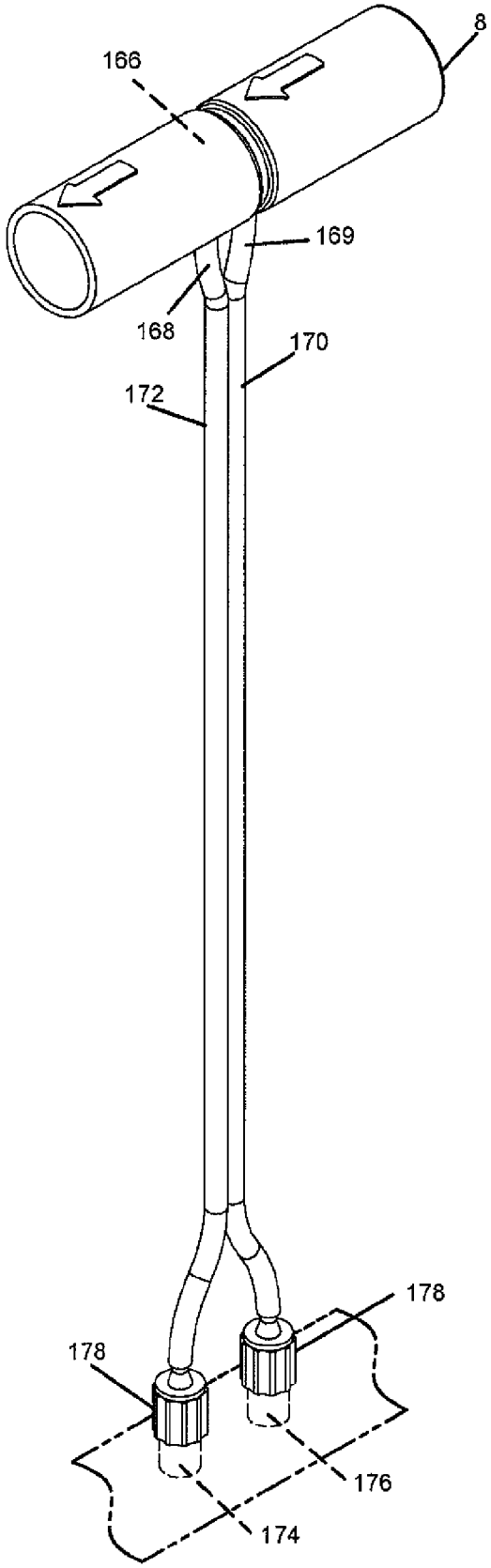
FIG. 15 is a perspective illustration of a mouthpiece device of FIG. 1.
Figure 16:
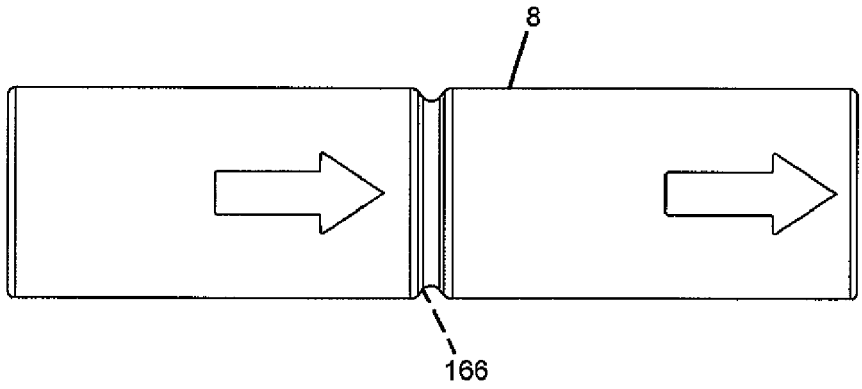
FIG. 16 is a top view of the mouthpiece of FIG. 15.
Figure 17:
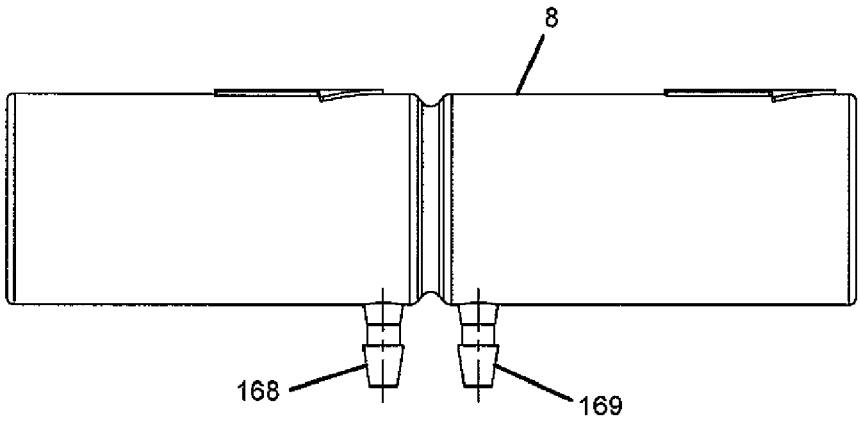
FIG. 17 is a side view of the mouthpiece of FIG. 15.
Figure 18:
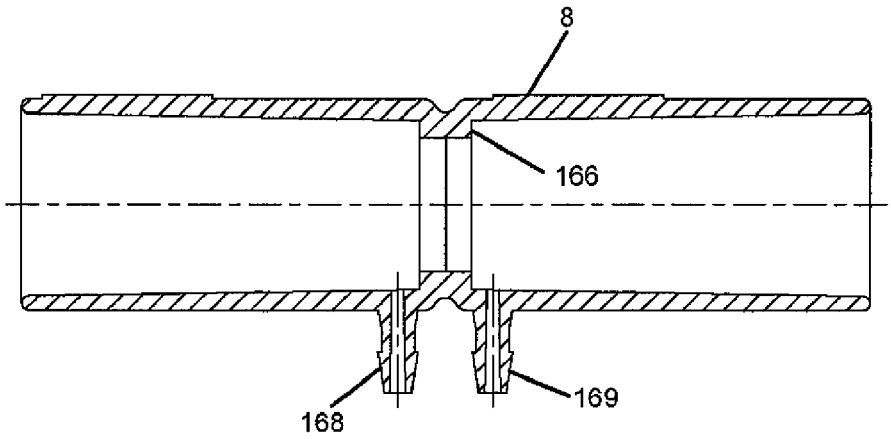
FIG. 18 is a cross sectional view of the mouthpiece taken along lines 5-5 in FIG. 16.

FIG. 14 illustrates a somewhat diagrammatical schematic of system 10. Controller 160 is connected to modem interface 76 permitting communication to and from system 10 to a remote location. Examples of communication include monitoring of system 10 performance, updating software used by controller 160 monitoring patient compliance, performing remote system diagnostics, etc. Controller 160 provides control of stepper motor 21 providing rotational control to fan 20. Controller 160, in this embodiment, in communication with the pulse oximeter system and the lung function mouthpiece sensor. With sensor input from the oximeter and/or mouthpiece, controller 160 may adjust one or more operational parameters of system 10. For example, controller 160 may change the speed of motor 21 as a function of patient airway as indicated by the mouthpiece data. In another example, controller 160 may adjust the output of air flow generator 12 based on a lung function trend analysis using mouthpiece 8

Various user interfaces allows the patient to control system 10. System 10 activation/deactivation is controlled through on/off switch 77. The user interface includes touch-sensitive display panel 73. Display panel 73 is preferably an LCD panel display, although other displays could also be used. Display panel 73 shows the status of system 10 and options available for usage, optimization and/or modification of system 10. System 10 also provides a variety of feed back to the patient as to system status, blood oxygen saturation, lung function trending, etc. For example, the display 73 may be utilized to coordinate usage of the pulse oximeter and mouthpiece sensor 8 during therapy sessions. Data may be collected by the system 10 relating to system use, operation, errors, status, patient compliance and a variety of patient physiological data. Data may be transferred from system 10 to a remote system via various wired or wireless means, including but not limited to BLUETOOTH transmissions and removable memory appliances. Data across multiple systems may be utilized in outcome assessments.

In a related manner, update information may be stored on a removable memory appliance and transferred to system 10 or transmitted wirelessly directly to system 10 from a remote source. The updated information may include operating software, software updates, etc. In one embodiment, a removable memory appliance may be used to transmit data both to/from a remote system, the data including patient and system data and update information.

FIGS. 15-18 illustrate various view of physiological sensor accessory 8 adapted for use with a congestion monitor of system 10. Sensor 8 is a mouthpiece through which a patient exhales. Sensor 8 defines an open ended tube having an interior flow restriction 166 and a pair of air ports 168, 169. The mouthpiece sensor 8 may be generally cylindrical in form, as shown, or may assume alternative shapes. The flow restriction 166 may be a ring form, as shown, or may assume alternative configurations. The flow restriction 166 may be generally centered along the length of the mouthpiece tube or may be offset relative to center. It is envisioned that a variety of different mouthpiece configurations could be utilized in alternative designs suitable for use within system 10.

Mouthpiece sensor 8 is connected to system 10 via a pair of flexible tubes 170, 172. Tubes 170, 172 engage the airports 168, 169 of mouthpiece sensor 8 at one end and are coupled to air ports of system 10 via threaded couplings 178 at the other end (as shown in FIG. 2). System 10 includes a differential air pressure sensor (not shown) in communication with the controller of system 10.

The patient may be prompted to use mouthpiece sensor 8 by a visual and/or auditory cue provided by system 10. For example, a variety of visual displays may illustrate to the patient the correct manner of use, via for example a video displayed on panel 73. The visual display may also facilitate proper use of the mouthpiece accessory by indicating proper airflow and providing an alarm when, for example, the airflow is insufficient to provide an accurate reading or the airflow is reversed. Various entertainment programs could be utilized via display 73 to encourage routine use of the mouthpiece sensor by the patient. For example, system 10 may implement an age-appropriate game on display 73 promoting increased compliance by a pediatric patient. A variety of such games are envisioned with data from one or more physiological data sensors providing real-time user input for the games.

In another embodiment system 10 may include a $CO_2$ or other gas monitor to evaluate patient condition. A $CO_2$ monitor could be provided as a small gas sampler within the housing of system 10.

System 10 includes a congestion monitor designed to measure total volume of air expired in the first one second of a forced expiratory breath. This value when monitored on a regular basis can be a valuable tool in managing chronic obstructive pulmonary disease. It is often difficult for a patient to determine the gradual trending direction of his or her lung function without pulmonary testing over time. Using the congestion monitor on a regular basis can indicate to the patient whether his or her lung function is stable, decreasing, or improving. It gives the patient the opportunity to better judge the right combination of therapy, whether or not to increase therapy, and/or to contact his or her doctor.

The congestion monitor was designed to measure, with consistency, a one second volume of air flow. This measurement is repeatable to within plus or minus 3 percent over a range of 0 to 12 liters per second. The consistency of measurement allows the patient to establish a base line measurement that can be used to show trending of lung congestion over time. It is not a measure of true FEV1 values and should not be compared to FEV1 values measured in a pulmonary function laboratory. Additional disclosure relating to the mouthpiece and airway congestion monitoring system are disclosed in applicant's US Provisional Patent Application, Mouthpiece and Airway Congestion Monitoring System, Ser. No. 61/161,707, incorporated by reference herein.

HFCC therapy is prescribed as either an adjunct or outright replacement for manual chest physiotherapy. Total therapy time per day varies between about 30 minutes and about 240 minutes spread over one to four treatments per day. Patients can be instructed in either the continuous intermittent mode of HFCC therapy, which may include continuous use of aerosol.

System 10 is provided in the form of a compact air pulse delivery apparatus that is considerably smaller than those presently or previously on the market, with no single modular component of the present apparatus weighing more than about 10 pounds. Air flow generator module 12 is provided in the form of a single stage compressor, and is enclosed in a compartment having air inlet and outlet ports. The air inlet port can be open to atmosphere, while the outlet port can be flowably coupled to the pulse frequency control module. In another embodiment, the air flow generator module 12 may include a variable speed air fan adapted to be used with an electronic motor speed controller. In such an embodiment, the amplitude of pulses transmitted to the air vest 18 may be controlled by adjusting the fan motor speed. In embodiments of the present invention, the amplitude of the pulses may be increased or decreased in response to received physiological signals providing patient information, such as inhalation and exhalation periods, etc.

System 10 can provide pressurized pulses of on the order of 60 mm Hg or less. The ability to provide pulses having higher pressure, while also minimizing the overall size and weight of the unit, is a particular advantage of the present apparatus as well. Pulses of over about 60 mm Hg are generally not desirable, since they can tend to lead to bruising.

System 10 may include one or more display screens allowing the caregiver to control the operation of any of the additional respiratory therapy system(s) and/or assessment system(s) included in system 10. The set of operating parameters may be stored in the on-board memory associated with the controller or microprocessor. The system housing has two large air ports which are configured to be coupled to a HFCC therapy garment via hoses. The garment has at least one bladder and is configured to be positioned on a patient receiving HFCC therapy. An example of a garment suitable for use with the system is disclosed in U.S. Ser. No. 12/106,836, which is hereby incorporated by reference herein. In response to user inputs, the controller signals air pulse generator to deliver high frequency air pulses to the patient in accordance with a set of operating parameters.

In some embodiments, system 10 may also be couplable to a nebulizer mouthpiece (not shown). A mask and/or nebulizer mouthpiece can be used when the system performs one or more of the integrated additional therapies such as, for example, nebulizer therapy and cough assist therapy.

The controller of system 10 signals the air pulse generator to deliver high frequency air pulses to a patient in accordance with the portion of the set of operating parameters stored in a memory device. In some embodiments, the memory device is configured to store one or more of a plurality of pre-programmed therapy modes to allow a caregiver to deliver HFCC therapy to a patient in accordance with any one of the plurality of pre-programmed therapy modes stored in the memory device. Examples of the pre-programmed therapy modes include a step program mode, a sweep program mode, a training program mode, and the like. The step and sweep program modes are substantially as described in U.S. Ser. No. 11/520,846, which is already incorporated by reference herein. A program mode allows the caregiver to start at a desired starting frequency and/or intensity for the HFCC therapy and automatically gradually increase the frequency and/or intensity over a predetermined period of time or a programmed period of time to a desired maximum frequency and intensity.

System 10 may include a memory device configured to store one or more of a plurality of customized therapy modes to allow a caregiver to deliver HFCC therapy to a patient in accordance with any one of the plurality of customized therapy modes stored in the memory device. In the custom program mode, the caregiver is able to create a special waveform for a particular patient's therapy. Such a special waveform may be in accordance with wave type, frequency, pressure, and timing parameters of the caregiver's choosing or may be in accordance with a menu of special waveforms preprogrammed into the system. In still other embodiments, a memory device is configured to store information regarding functionalities available to a patient. Examples of functionalities available to a patient include one or more of a positive expiratory pressure (PEP) therapy, a nebulizer therapy, an intermittent positive pressure breathing (IPPB) therapy, a cough assist therapy, a suction therapy, a bronchial dilator therapy, and the like.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chest compression apparatus comprising:

a garment having an air bladder adapted to engage at least a portion of the thoracic region of a patient;

an air valve assembly having an air port in fluid communication with a pressurized air source, a vent port in fluid communication with an air vent, and a pair of bladder-side ports, said air valve assembly providing selective fluid communication between the air vent and one of the pair of bladder-side ports and between the vent port and the other bladder-side port;

an air manifold coupled to the air valve assembly, with said air valve assembly periodically interrupting a flow of pressurized air from said source into said air manifold, and said air manifold providing fluid communication between the pair of bladder-side ports and a pair of air lines coupled to the air bladder and with said pair of air lines communicating a series of air pulses to said air bladder, said series of air pulses being established by the flow of pressurized air first through the air valve assembly and then through the air manifold;

a mouthpiece sensor including a sensor body adapted to be inserted into a mouth of the patient, said mouthpiece sensor providing air flow information relating to patient use of the garment during a therapy session; and a controller in communication with the mouthpiece sensor, said controller adjusting an operating condition of the apparatus based on said air flow information provided by said mouthpiece sensor during said therapy session.

2. The chest compression apparatus of claim 1 wherein the air valve assembly comprises a rotating valve which periodically interrupts air flow between the vent port and a second air line.

3. The chest compression apparatus of claim 2 wherein the series of air pulses define a pressure waveform which includes one or more minor perturbations or fluctuations within the pressure waveform.

4. The chest compression apparatus of claim 2 wherein the rotating valve includes a motor-driven blade.

5. The chest compression apparatus of claim 1 wherein said pair of air lines include a flexible tubing having quick-connect air fittings with a latch to facilitate immediate connection and disconnection of said flexible tubing into said apparatus.

6. The chest compression apparatus of claim 1 further comprising a pulse oximeter or a blood gas content sensor or both.

7. The chest compression apparatus of claim 6 wherein the pulse oximeter includes circuitry for generating light pulses and for detecting light having passed through at least a portion of the patient.

8. The chest compression apparatus of claim 1 wherein the mouthpiece sensor is defined as an open-ended tube having an interior restriction and a pair of air ports.

9. The chest compression apparatus of claim 8 wherein the air ports are in fluid communication with a pair of sensing air ports on a housing via a pair of flexible air tubes.

10. The chest compression apparatus of claim 1 comprising a display monitor.

11. The chest compression apparatus of claim 10 wherein the display monitor is a touch-sensitive display adapted as a user interface.

12. The chest compression apparatus of claim 10 wherein the display monitor provides a visual display to the patient relating to operation of the physiological data acquisition device.

13. The chest compression apparatus of claim 12 wherein the display monitor provides visual prompting to the patient towards maintaining patient compliance with a given therapy protocol.

14. The chest compression apparatus of claim 13 wherein the visual prompting is provided via a game or other entertainment scheme visually presented to a patient during said therapy session.

15. The chest compression apparatus of claim 1 further comprising means for conveying or receiving information from a remote system.

16. The chest compression apparatus of claim 15 wherein the means for conveying or receiving includes a wireless transmission or a removable memory appliance or both.

17. The chest compression apparatus of claim 15 wherein the means for conveying or receiving provides update information including software upgrades for a system controller.

18. A chest compression apparatus comprising:

a garment having an air bladder adapted to engage at least a portion of the thoracic region of a patient;

an air valve assembly having an air port in fluid communication with a pressurized air source, a vent port in fluid communication with an air vent, and a pair of bladder-side ports, said air valve assembly providing selective fluid communication between the air vent and one of the pair of bladder-side ports and between the vent port and the other bladder-side port;

an air manifold coupled to the air valve assembly, with said air valve assembly periodically interrupting a flow of pressurized air from said source into said air manifold, and said air manifold providing fluid communication between the pair of bladder-side ports and a pair of air lines coupled to the air bladder and with said pair of air lines communicating a series of air pulses to said air bladder, said series of air pulses being established by the flow of pressurized air first through the air valve assembly and then through the air manifold;

a mouthpiece sensor adapted for coupling to the patient and providing a signal relating to a patient airway condition during a therapy session; and a controller in communication with a pressure sensor, said controller changing the frequency or amplitude or both of the series of air pulses based on said signal provided by said mouthpiece sensor.

19. The chest compression apparatus of claim 18 wherein the air valve assembly comprises a rotating valve which periodically interrupts air flow between the vent port and a second air line.

20. The chest compression apparatus of claim 19 wherein the rotating valve includes a motor-driven blade.

21. The chest compression apparatus of claim 18 wherein the mouthpiece sensor is defined as an open-ended tube having an interior restriction and a pair of air ports.

22. The chest compression apparatus of claim 21 wherein the pair of air ports is in fluid communication with a pair of sensing air ports on a housing via a pair of flexible air tubes.

23. A method of applying pressure pulses to the thoracic region of a patient comprising the steps of:

connecting a garment having an air bladder to a pressurized air line, with said air bladder being positioned at the thoracic region of the patient;

connecting the air bladder to a vent line;

connecting the pressurized air line and the vent line to an air manifold;

connecting the air manifold to an air valve assembly, said air valve assembly including a rotating disk valve element which periodically interrupts air flow within the air line or the vent line or both to apply a series of pulses from the air valve assembly to the air manifold and the air bladder and thoracic region;

bypassing some air from the pressurized air line into said vent line via said air manifold while the series of pulses are conveyed to the air bladder;

connecting a mouthpiece sensor to the patient, said mouthpiece sensor including a body adapted to be inserted into a mouth of the patient;

monitoring lung function of the patient via said mouthpiece sensor; and adjusting one or more operational conditions to control the series of pulses conveyed to the air bladder based on said monitoring.

24. The method of claim 23 wherein rotation of the disk valve element is electronically controlled so that a frequency of the air pulses can be adjusted.

25. The method of claim 23 further comprising the step of:

changing an amplitude of the air pulses during a therapy session based on said monitoring.

* * * * *